US007549311B2

(12) United States Patent
Break

(10) Patent No.: US 7,549,311 B2
(45) **Date of Patent: *Jun. 23, 2009**

(54) SHEET METAL BENDING BRAKE

(75) Inventor: Douglas G. Break, Livonia, MI (US)

(73) Assignee: Tapco International Corporation, Wixom, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/044,839

(22) Filed: Mar. 7, 2008

(65) Prior Publication Data

US 2008/0216549 A1 Sep. 11, 2008

Related U.S. Application Data

(60) Continuation of application No. 11/676,857, filed on Feb. 20, 2007, now abandoned, which is a division of application No. 10/984,124, filed on Nov. 9, 2004, now Pat. No. 7,191,631.

(60) Provisional application No. 60/520,472, filed on Nov. 14, 2003, provisional application No. 60/532,281, filed on Dec. 23, 2003.

(51) Int. Cl.
*B21D 11/00* (2006.01)

(52) U.S. Cl. ..... 72/319

(58) Field of Classification Search ..... 72/319, 72/320, 321, 387, 388, 452.4, 452.5, 452.6, 72/293

See application file for complete search history.

(56) References Cited

U.S. PATENT DOCUMENTS

| | | | | |
|---|---|---|---|---|
| 864,663 | A | 8/1907 | Markel | |
| 3,359,771 | A | 12/1967 | Meyerchick, Jr. | |
| 3,380,280 | A * | 4/1968 | Wise | 72/319 |
| 3,817,075 | A | 6/1974 | Marsh et al. | |
| 3,877,279 | A | 4/1975 | Van Cleave | |
| 4,081,986 | A | 4/1978 | Break | |
| 4,092,841 | A | 6/1978 | Chambers, Jr. | |
| 4,240,279 | A | 12/1980 | Rhoades | |
| 4,282,735 | A | 8/1981 | Break | |
| 4,321,817 | A | 3/1982 | Barnack | |
| 4,364,254 | A | 12/1982 | Chubb et al. | |
| 4,372,142 | A | 2/1983 | Rhoades | |
| 4,445,356 | A | 5/1984 | Chubb et al. | |
| 4,489,583 | A | 12/1984 | Rhoades | |
| 4,493,200 | A | 1/1985 | Rhoades | |
| 4,494,397 | A | 1/1985 | Rhoades | |
| 4,512,174 | A | 4/1985 | Rhoades | |
| RE31,938 | E | 7/1985 | Klukow | |
| 4,557,132 | A | 12/1985 | Break | |
| 4,557,684 | A * | 12/1985 | Romine et al. | 425/383 |
| 4,558,582 | A * | 12/1985 | Meinig | 72/381 |

(Continued)

*Primary Examiner*—Edward Tolan
(74) *Attorney, Agent, or Firm*—Howard & Howard Attorneys PLLC

(57) ABSTRACT

A sheet metal bending brake having a frame with a sheet metal support surface. A clamping jaw is movable relative to the frame support surface to clamp the sheet metal between the clamping jaw and the frame. The clamping jaw has a linear front edge. An elongated bending arm is pivotally mounted to the frame by an elongated flexible strap having spaced apart edges. One edge of the strap is secured to the bending arm while the other edge of the strap is secured to the frame such that the bending arm extends parallel to and closely adjacent the clamping jaw front edge.

29 Claims, 4 Drawing Sheets

U.S. PATENT DOCUMENTS 4,566,304 A 1/1986 Van Cleave et al.
4,592,518 A 6/1986 Chubb et al.
4,651,553 A 3/1987 Rhoades
4,671,094 A 6/1987 Break
4,766,757 A 8/1988 Break et al.
4,875,356 A * 10/1989 Boardman et al. ..... 72/321
5,343,728 A 9/1994 Chubb et al.
5,353,620 A 10/1994 Olsen et al.
5,505,069 A 4/1996 Break et al.
5,582,053 A 12/1996 Chubb et al.
5,582,055 A 12/1996 Chubb et al.
5,644,940 A 7/1997 Chubb et al.
5,706,692 A 1/1998 Chubb et al.
5,706,693 A 1/1998 Chubb et al.
5,743,129 A 4/1998 Chubb et al.
5,761,939 A 6/1998 Spencer et al.
5,992,203 A 11/1999 Chubb et al.
6,003,357 A 12/1999 Brown
6,085,569 A 7/2000 Chubb et al.
6,389,864 B1 5/2002 Chubb et al.
6,532,789 B1 3/2003 Chubb et al.
6,571,594 B2 6/2003 Clark
6,675,619 B2 1/2004 Clark
6,748,784 B1 6/2004 Chubb et al.
6,802,198 B2 10/2004 Clark
6,901,783 B2 6/2005 Clark
6,941,788 B2 9/2005 Goubaud
7,043,950 B2 5/2006 Clark et al.
7,117,705 B2 10/2006 Clark
7,191,631 B2 * 3/2007 Break ..... 72/319
7,228,721 B2 6/2007 Clark
2007/0277577 A1 12/2007 Allen et al.
2008/0034828 A1 2/2008 Clark

* cited by examiner

SHEET METAL BENDING BRAKE

RELATED APPLICATIONS

This application is a Continuation of U.S. Non-Provisional patent application Ser. No. 11/676,857 filed Feb. 20, 2007 now abandoned, which is a Divisional of U.S. Non-Provisional patent application Ser. No. 10/984,124 filed Nov. 9, 2004, now U.S. Pat. No. 7,191,631, which claims priority of U.S. Provisional Patent Application Ser. No. 60/520,472 filed Nov. 14, 2003 and Ser. No. 60/532,281 filed Dec. 23, 2003, which are incorporated herein by reference.

BACKGROUND OF THE INVENTION

I. Field of the Invention

The present invention relates generally to sheet metal bending brakes and, more particularly, to a sheet metal bending brake with an improved hinge.

II. Description of Related Art

There are many previously known portable sheet metal bending brakes that are used in the building industry, typically for the installation of aluminum siding. These previously known sheet metal bending brakes typically comprise a frame having a planar work support surface which supports the sheet metal as well as a plurality of spaced frame members which extend over the work support surface.

A plurality of elongated pivot arms are pivotally secured at one end to the spaced apart frame members. An elongated clamping jaw is then mounted to the opposite end of each pivot arm such that upon pivoting of the pivot arms, the clamping jaw moves toward and away from the work support surface on the frame.

Any conventional means can be used to move the pivot arms with their attached clamping jaw between their clamping and unclamped position. In their unclamped position, the clamping jaw is spaced apart from the sheet metal support surface thus permitting the insertion and/or removal of sheet metal into the bending brake. Conversely, when the pivot arms are moved to their clamping position, the sheet metal is sandwiched in between the clamping jaw and the work support surface on the frame. Any conventional means may be used to move the clamping jaw between its clamping and unclamped positions.

An elongated bending arm is pivotally mounted to the frame such that the bending arm extends along the front edge of the workpiece support surface on the frame closely adjacent the front edge of the clamping jaw when in its clamped position. Consequently, with a piece of sheet metal positioned in between the frame and the clamping jaw such that a portion of the sheet metal protrudes outwardly from the front edge of the clamping jaw, pivotal movement of the bending arm in turn engages the outwardly protruding portion of the sheet metal and bends that outwardly protruding portion in the desired fashion.

There have been many previously known devices for pivotally mounting the bending arm to the frame. All of these previously known pivoting mechanisms, however, all suffer from one or more common problems.

More specifically, many of the previously known hinge mechanisms for pivotally securing the bending arm to the frame scuffed the surface of the sheet metal during the bending operation. In many situations, such scuffing is cosmetically unacceptable.

Similarly, many of the previously known hinge mechanisms for sheet metal bending brakes are incapable of bending the sheet metal when only a very small amount of sheet metal protrudes outwardly from the clamping jaw. For example, many previously known bending brakes are incapable of forming a bend in sheet metal of less than 3/16 of an inch in width. Similarly, many of the previously known hinge mechanisms for sheet metal bending brakes are incapable of producing hems of very small widths.

SUMMARY OF THE PRESENT INVENTION

The present invention provides a portable sheet metal bending brake which overcomes all of the above-mentioned disadvantages of the previously known devices.

In brief, the sheet metal bending brake of the present invention comprises a frame having a sheet metal support surface extending longitudinally along the frame. A clamping jaw is movably mounted to the frame such that the clamping jaw is movable between a clamped position relative to the sheet metal support surface and an unclamped position. In its clamped position, the clamping jaw sandwiches a piece of sheet metal in between the clamping jaw and the sheet metal support surface on the frame. Conversely, in its unclamped position, the clamping jaw is spaced away from the sheet metal support surface to enable sheet metal to be positioned into or removed from the bending brake. Any conventional means may be used to move the clamping jaw between its clamped and unclamped position.

An elongated bending arm is pivotally mounted to the frame such that the arm extends longitudinally along the sheet metal frame adjacent the front edge of the sheet metal support surface. In order to pivotally secure the bending arm to the frame, an elongated flexible strap having spaced-apart edges is provided. One edge of the flexible strap is secured to the frame while an intermediate point of the flexible strap is secured to the bending arm such that the connection between the flexible strap and the bending arm is closely adjacent to and parallel to the front edge of the clamping jaw when the clamping jaw is in its clamped position.

Preferably the frame includes a semi-cylindrical bearing surface which extends parallel to and is spaced outwardly from the front edge of the jaw when the jaw is in its clamped position. The bending arm in turn includes a semi-cylindrical bearing surface which nests within the-frame bearing surface to provide support for the bending arm both during and after a bending operation. A bearing sleeve is also preferably sandwiched in between the bearing surfaces on the bending arm and frame.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
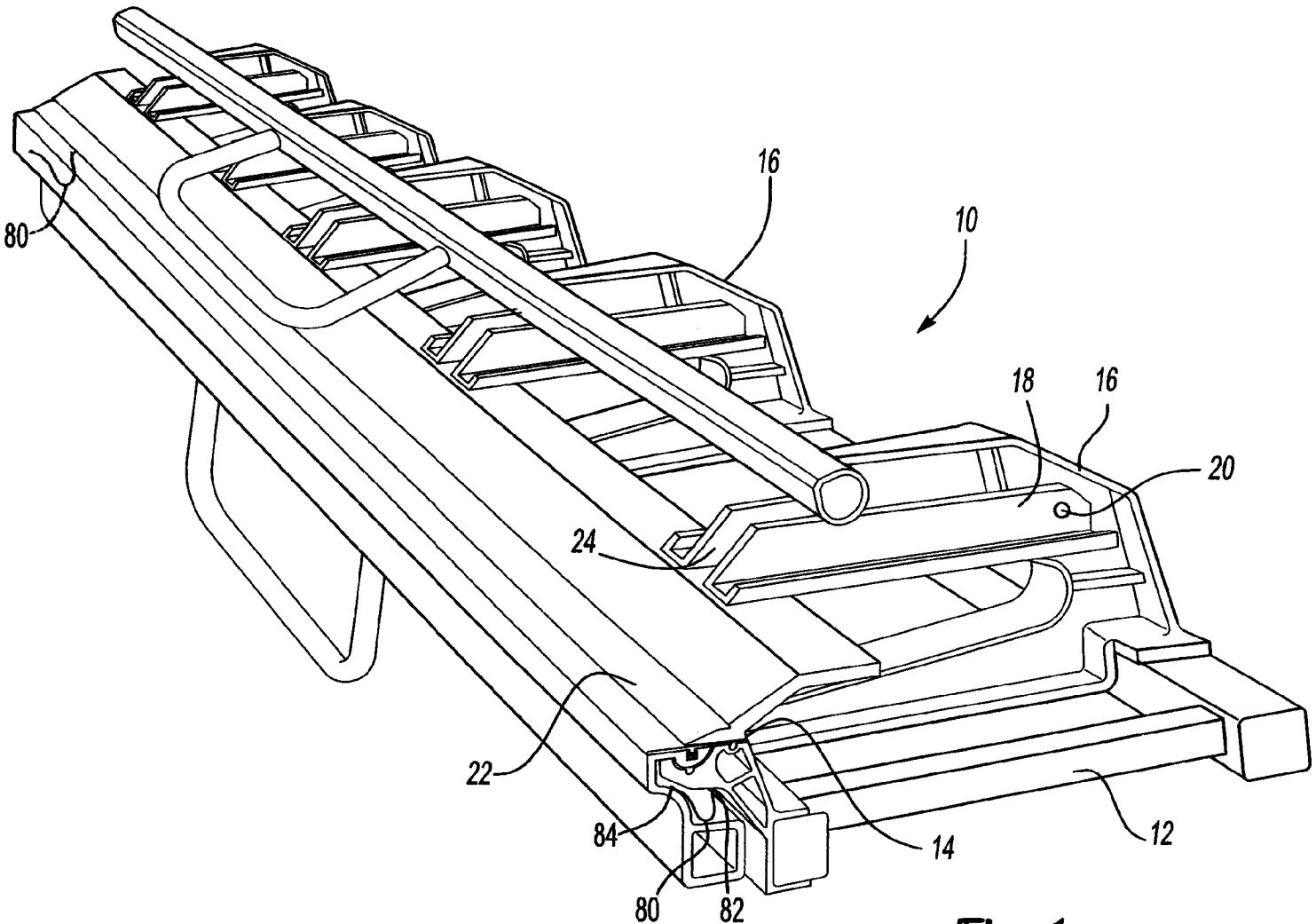
FIG. 1 is an elevational view illustrating a preferred embodiment of the present invention.

With reference first to FIG. 1, a preferred embodiment of the portable sheet metal bending brake 10 of the present invention is shown and includes a stationary frame 12 which is constructed of any rigid material, such as metal. The frame 12 is supported in any conventional fashion, such as by a stand (not shown). Additionally, the frame 12 includes an elongated sheet metal support surface 14 which is adapted to receive and support a piece of sheet metal within the bending brake 10.

A plurality of rigid frame members 16 are secured to the frame 12 such that the frame members 16 are longitudinally spaced from each other along the frame 12. The frame members 16 are secured to the frame 12 such that the frame members 16 are spaced upwardly from the sheet metal support surface 14.

A pivot arm 18 is pivotally secured at one end 20 to each frame member 16 so that the pivot arms 18 are also longitudinally spaced apart from each other along the frame 12. An elongated clamping jaw 22 is secured to the front or opposite end 24 of each pivot arm 18 so that the clamping jaw 22 extends longitudinally along the frame 12 above the sheet metal support surface 14.

Figure 2:
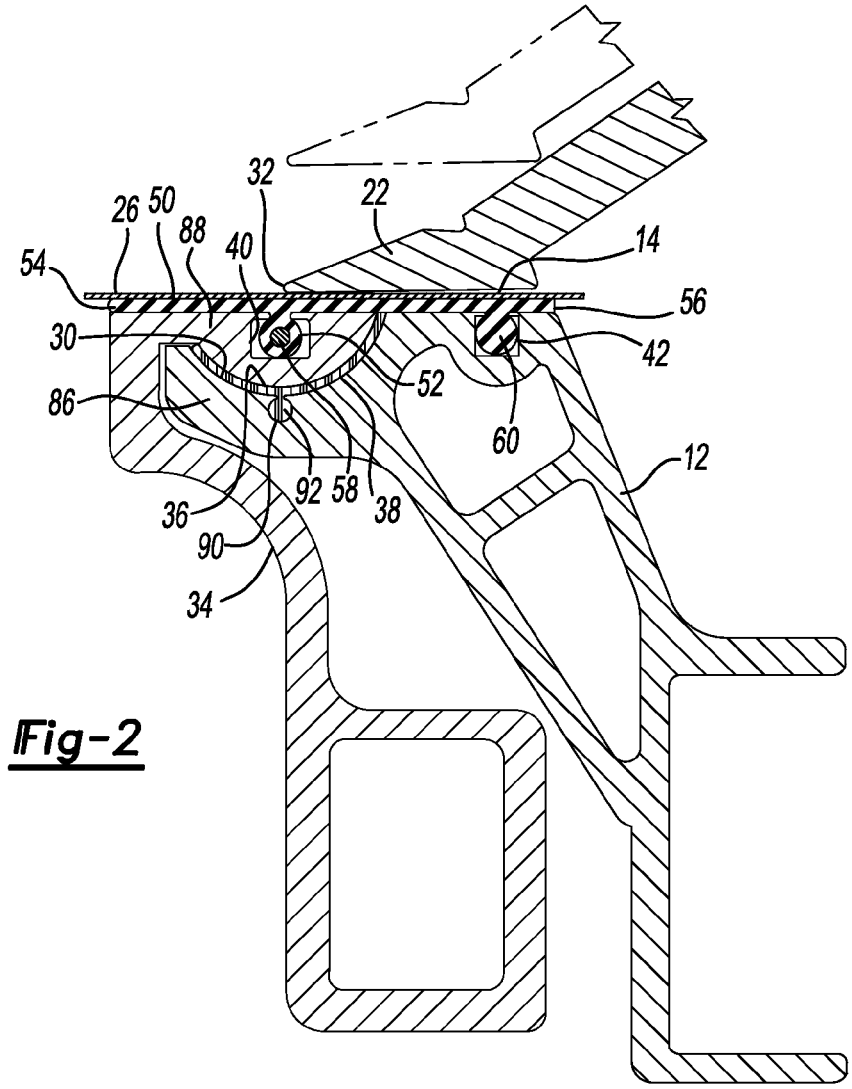
FIG. 2 is a fragmentary sectional view illustrating a portion of the preferred embodiment of the present invention.

With reference now to FIGS. 1 and 2, the clamping jaw 22 is movable between a clamped position, illustrated in solid line in FIG. 2, and an unclamped 10 position, illustrated in phantom line in FIG. 2. In its unclamped position (phantom line in FIG. 2), the clamping jaw 22 is spaced apart from the sheet metal support surface 14 to enable the insertion or removal of a piece 26 of sheet metal into the sheet metal bending brake 10. Conversely, in its clamped position (solid line in FIG. 2), the piece 26 of sheet metal is sandwiched in between the clamping jaw 22 and the sheet metal support surface 14 on the frame 12.

With reference now particularly to FIG. 2, the frame 12 includes a female portion 86 having a semi-cylindrical bearing surface 30 which extends longitudinally along the frame 12 and so that the bearing surface 30 is substantially aligned with a front edge 32 of the clamping jaw 22. Preferably, the cylindrical bearing surface 30 and the frame 12 are of a one-piece construction and thus rigid with respect to each other.

An elongated bending arm 34 also includes a male portion 88 having a semi-cylindrical bearing surface 36 which is complementary in shape to the bearing surface 30 on the frame 12. The bending arm 34 is mounted to the frame 12 so that the bending arm bearing surface 36 is nested within and supported by the bearing surface 30 on the frame 12, i.e., forming a socket connection including the male portion and the female portion in sliding engagement with one another. Additionally, a bearing sleeve 38 is sandwiched in between the bearing surfaces 30 and 36 to minimize friction between the bending arm 34 and frame 12. As shown in FIGS. 1-5, the frame 12 defines a recess 90 extending longitudinally along the frame 12 and the bearing sleeve 38 defines a projection 92 engaged with and extending longitudinally along the recess 90. The recess 90 is semi-cylindrical and the projection 92 is semi-cylindrical and complementary to the recess 90. The bearing sleeve 38 may be of any conventional construction, such as a high molecular weight synthetic material and/or a fluoropolymer.

Referring to FIG. 2, a T slot or rectangular channel 40 is formed in the bending arm 34 and the channel 40 is aligned with the front edge 32 of the clamping jaw 22. Similarly, a T slot or channel 42 is also formed in the frame 12 such that the channels 40 and 42 are spaced apart and generally parallel to each other.

Figure 3:
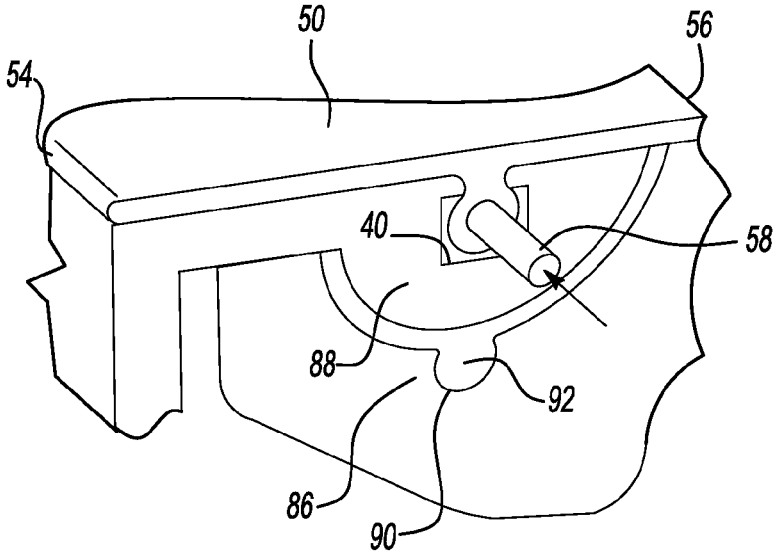
FIG. 3 is a fragmentary view illustrating a portion of the preferred embodiment of the present invention.

An elongated flexible strap 50, preferably constructed of polyurethane, pivotally secures the bending arm 34 to the frame 12. As best shown in FIG. 2, the 15 flexible strap 50 includes a first longitudinally extending protrusion 52 at an intermediate point between the sides or edges 54 and 56 of the flexible strap 50. This protrusion 52 is positioned within the channel 40 formed on the bending brake 34. In order to ensure a locking engagement between the flexible strap 50 and the bending brake 34, a metal pin 58, best shown in FIGS. 2 and 3, is inserted into a longitudinal 20 bore formed in the protrusion 52 after insertion of the protrusion 52 into the channel 40.

The flexible strap 50 also preferably includes a second elongated protrusion 60 which extends longitudinally along the strap 50 adjacent its rear edge 56. This protrusion 60 is lockingly positioned within the channel 42 formed on the frame 12.

Figure 4:
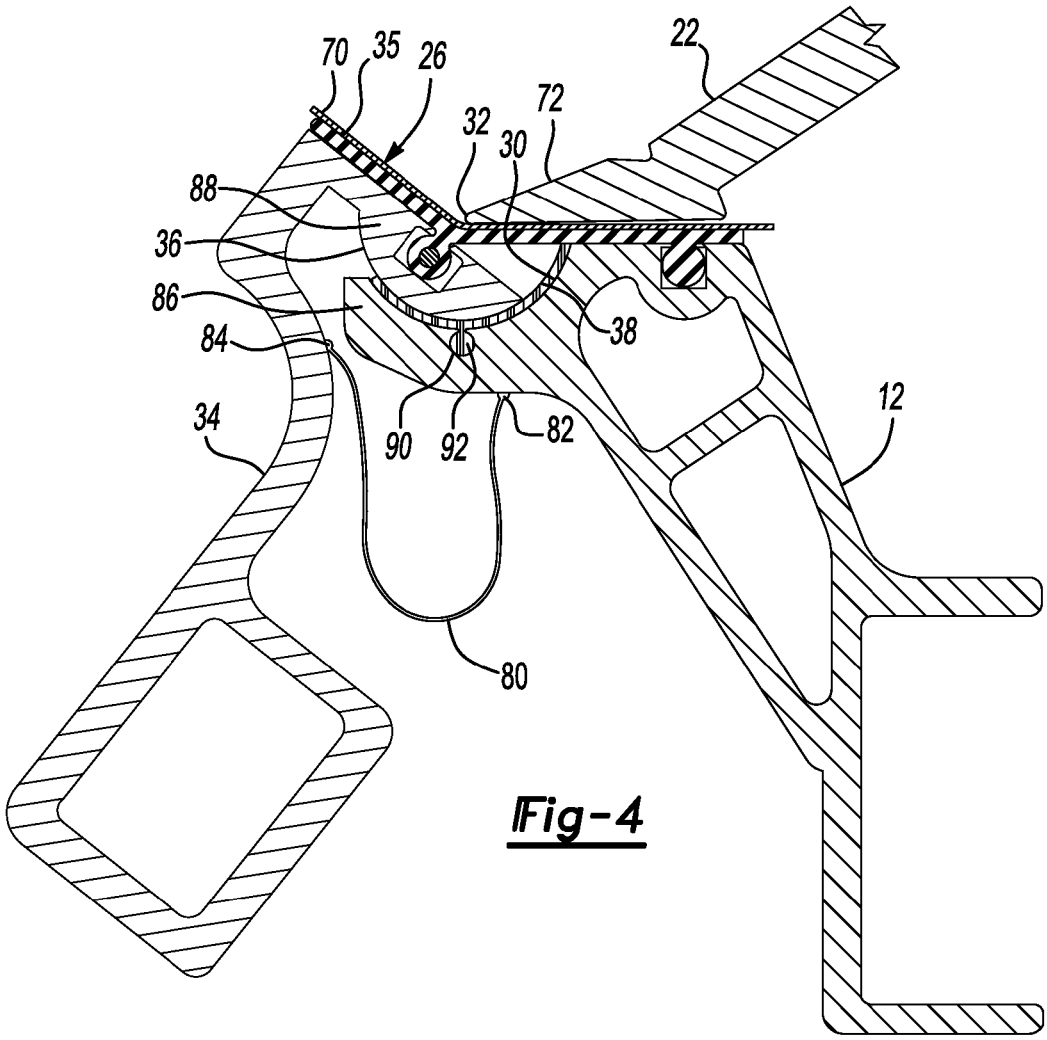
FIG. 4 is a view similar to FIG. 2, but illustrating the operation of the sheet metal bending brake of the present invention.

With reference now to FIG. 4, the operation of the bending brake 10 will now be described. First, the piece 26 of sheet metal is positioned in between the clamping jaw 22 and the frame 12 so that, when the clamping jaw 22 is moved to its clamped position, the piece 26 of sheet metal is rigidly held to the frame 12 and so that a portion 70 of the sheet metal to be bent protrudes outwardly from the front edge 32 of the clamping jaw 22. Thereafter, the bending arm 34 is pivoted from the position shown in FIG. 2 and toward the position shown in FIG. 4. In doing so, the bearing surfaces 30 and 36 on the frame 12 and bending arm 34 pivot relative to each other. As the bending arm 34 is pivoted, the portion 35 of the bending arm 34 beneath the protruding portion 70 of the sheet metal piece 26 bends the sheet metal 70 about the outer edge 32 of the clamping arm 22. It will be understood, of course, that the degree of bending of the sheet metal portion 70 shown in FIG. 4 is by way of example only and hut sheet metal bends of different angles are formed by merely pivoting the bending arm 34 to the desired angle relative to the frame 12.

Figure 5:
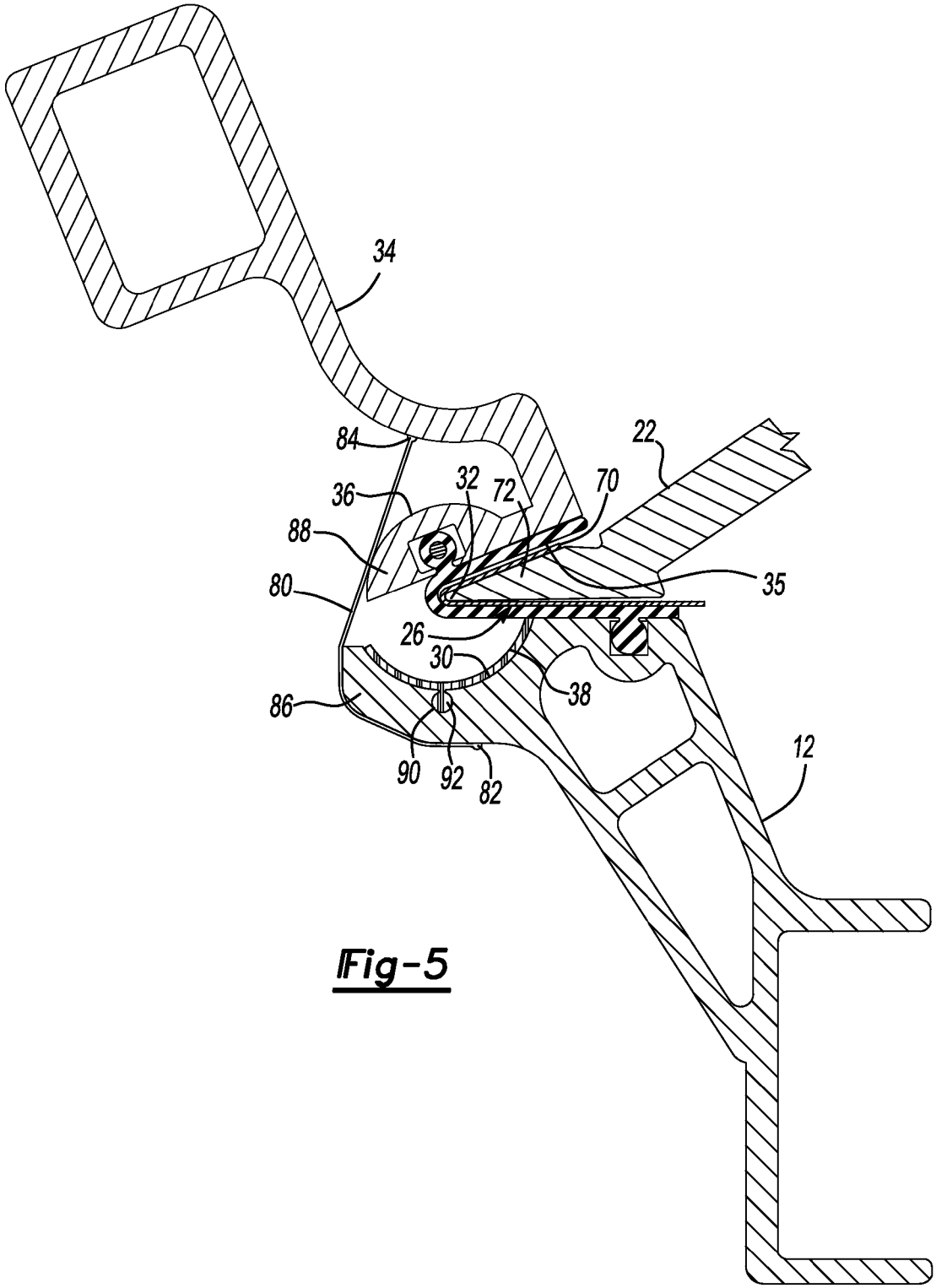
FIG. 5 is a view similar to FIG. 4 but illustrating the sheet metal bending 10 brake in a full bend position.

With reference now to FIGS. 1 and 5, at least one, and preferably two or more spaced non-elastic cables 80 each have one end 82 secured to the frame 12 and their other end 84 secured to the bending arm 34. The cables 80 each have a length such that, during a full bend operation as illustrated in FIG. 5 in which the bending arm 34 sandwiches the sheet metal between the bending arm 34 and the clamping jaw 22, the cables 80 become taut and abut against both the bending arm 34 and the frame 12 to limit the rotation of the bending arm 34 to the full bend position shown in FIG. 5. In practice the cables 80, by limiting the pivotal position of the bending arm 34 relative to the frame 12, prevent stretching of the flexible strap 50. Furthermore, the cables 80 may alternatively be in the form of a non-elastic flat strap.

In practice, the provision of the flexible strap 50 for pivotally securing the bending arm 34 to the frame 12 not only prevents scuffing of the sheet metal during the bending operation but also enables very narrow outwardly protruding portions 70 of the sheet metal to be bent due to the continuous contact between the flexible strap 50 and the sheet metal.

Additionally, the sheet metal bending brake can also be used to perform hems. In order to perform a hem, the outwardly protruding portion 26 of the sheet metal is bent against the top of the clamping jaw 22. The clamping jaw 22 is then moved to its unclamped position and the bent sheet metal removed from the sheet metal bending brake. Thereafter, the bent portion of the sheet metal is positioned on a top surface 72 (FIG. 4) of the clamping jaw 22 and the bending arm 34 pivoted against the top surface 72 of the clamping jaw 22 to finalize the hem.

From the foregoing, it can be seen that the present invention provides a simple and yet highly effective portable sheet metal bending brake with an improved hinge for the bending arm. Having described my invention, however, many modifications thereto will become apparent to those skilled in the art to which it pertains without deviation from the spirit of the invention as defined by the scope of the appended claims.

I claim:

1. A bending brake assembly for manually bending pieces of sheet metal material comprising:

a frame;

a clamping jaw coupled to said frame for movement between a clamped position and an unclamped position;

a bending arm, a socket connection rotatably supporting said bending arm on said frame for bending a piece of sheet metal material disposed between said clamping jaw and at least one of said frame and said bending arm, said socket connection including a male portion and a female portion in sliding engagement with one another, a bearing sleeve being sandwiched between said male portion and said female portion for facilitating relative movement between said male portion and said female portion, and a first mechanical connection connecting said bearing sleeve to one of said male portion and said female portion, said first mechanical connection includes a projection and a recess for securing said bearing sleeve to one of said portions.

2. A bending brake assembly as set forth in claim 1 wherein said frame defines said recess extending longitudinally along said frame and said bearing sleeve defines said projection engaged with and extending longitudinally along said recess.

3. A bending brake assembly as set forth in claim 2 wherein said recess is semi-cylindrical and said projection is semi-cylindrical and complimentary to said recess.

4. A bending brake assembly as set forth in claim 1 wherein said female portion and said male portion are arcuate and said bearing sleeve is arcuate and complementary to said male and female portions.

5. A bending brake assembly as set forth in claim 1 wherein said female portion of said frame includes a first semi-cylindrical bearing surface extending longitudinally along said frame and wherein said male portion of said bending arm includes a semi-cylindrical bearing surface complimentary to said first semi-cylindrical bearing surface and wherein said bearing sleeve is semi-cylindrical and complementary to said first and second cylindrical bearing surfaces.

6. A bending brake assembly as set forth in claim 1 wherein said bearing sleeve is formed of a polymer.

7. A bending brake assembly as set forth in claim 1 further including a flexible strap supported by said frame and said bending arm for protective receipt the piece of sheet metal material directly between said flexible strap and said clamping jaw.

8. A bending brake assembly as set forth in claim 7 wherein said flexible strap is disposed between the piece of sheet metal material and the bending arm 9. A bending brake assembly as set forth in claim 8 wherein movement of said bending arm plastically bends the piece of sheet metal material about the clamping jaw and resiliently flexes the flexible strap about the clamping jaw and the piece of sheet metal material.

10. A bending brake assembly as set forth in claim 7 wherein said flexible strap has a first protrusion received in a first groove in said bending arm for locking engagement to said bending arm and wherein said flexible strap has a second protrusion received in a second groove in said frame for locking engagement to said frame.

11. A bending brake assembly as set forth in claim 10 wherein said first protrusion is located beneath said clamping jaw when said bending arm is in a staged position and is located above the clamping jaw when the bending arm is in an operated position.

12. A bending brake assembly as set forth in claim 7 wherein said flexible strap is elastic.

13. A bending brake assembly as set forth in claim 12 further including a second flexible strap that is non-elastic and connected directly between said bending arm and said frame.

14. A bending brake assembly as set forth in claim 7 wherein said flexible strap is made of polyurethane.

15. A bending brake assembly for manually bending pieces of sheet metal material comprising:

a frame;

a clamping jaw coupled to said frame for movement between a clamped position and an unclamped position;

a bending arm, a socket connection rotatably supporting said bending arm on said frame for bending a piece of sheet metal material disposed between said clamping jaw and at least one of said frame and said bending arm, said socket connection including a male portion and a female portion in sliding engagement with one another, a bearing sleeve in contact with said male portion and being sandwiched between said male portion and said female portion for facilitating relative movement between said male portion and said female portion, wherein said bearing sleeve is formed of a polymer.

16. A bending brake assembly as set forth in claim 15 including a first mechanical connection connecting said bearing sleeve to one of said male portion and said female portion.

17. A bending brake assembly as set forth in claim 16 wherein said first mechanical connection includes a projection and a recess for securing said bearing sleeve to one of said portions.

18. A bending brake assembly as set forth in claim 17 wherein said frame defines said recess extending longitudinally along said frame and said bearing sleeve defines said projection engaged with and extending longitudinally along said recess.

19. A bending brake assembly as set forth in claim 18 wherein said recess is semi-cylindrical and said projection is semi-cylindrical and complimentary to said recess.

20. A bending brake assembly as set forth in claim 15 wherein said female portion and said male portion are arcuate and said bearing sleeve is arcuate and complementary to said male and female portions.

21. A bending brake assembly as set forth in claim 15 wherein said female portion of said frame includes a first semi-cylindrical bearing surface extending longitudinally along said frame and wherein said male portion of said bending arm includes a semi-cylindrical bearing surface complimentary to said first semi-cylindrical bearing surface and wherein said bearing sleeve is semi-cylindrical and complementary to said first and second cylindrical bearing surfaces.

22. A bending brake assembly as set forth in claim 15 further including a flexible strap supported by said frame and said bending arm for protective receipt the piece of sheet metal material directly between said flexible strap and said clamping jaw.

23. A bending brake assembly as set forth in claim 22 wherein said flexible strap is disposed between the piece of sheet metal material and the bending arm.

24. A bending brake assembly as set forth in claim 23 wherein movement of said bending arm plastically bends the piece of sheet metal material about the clamping jaw and resiliently flexes the flexible strap about the clamping jaw and the piece of sheet metal material.

25. A bending brake assembly as set forth in claim 22 wherein said flexible strap has a first protrusion received in a first groove in said bending arm for locking engagement to said bending arm and wherein said flexible strap has a second protrusion received in a second groove in said frame for locking engagement to said frame.

26. A bending brake assembly as set forth in claim 25 wherein said first protrusion is located beneath said clamping jaw when said bending arm is in a staged position and is located above the clamping jaw when the bending arm is in an operated position.

27. A bending brake assembly as set forth in claim 22 wherein said flexible strap is elastic.

28. A bending brake assembly as set forth in claim 27 further including a second flexible strap that is non-elastic and connected directly between said bending arm and said frame.

29. A bending brake assembly as set forth in claim 22 wherein said flexible strap is made of polyurethane.

* * * * *